US007101264B2

(12) United States Patent
White

(10) Patent No.: US 7,101,264 B2
(45) Date of Patent: Sep. 5, 2006

(54) DRESSING WHEEL SYSTEM

(75) Inventor: Hollis Newcomb White, Hopkinsville, KY (US)

(73) Assignee: White Drive Products, Inc., Hopkinsville, KY (US)

( * ) Notice: Subject to any disclaimer, the term of this patent is extended or adjusted under 35 U.S.C. 154(b) by 701 days.

(21) Appl. No.: 09/740,177

(22) Filed: Dec. 18, 2000

(65) Prior Publication Data

US 2001/0004579 A1 Jun. 21, 2001

Related U.S. Application Data

(62) Division of application No. 09/217,380, filed on Dec. 21, 1998, now Pat. No. 6,338,672.

(51) Int. Cl.
*B24B 9/00* (2006.01)

(52) U.S. Cl. ..... 451/72; 451/56; 451/443

(58) Field of Classification Search ..... 451/56, 451/72, 261–269, 291, 443, 444, 495, 526, 451/530, 528, 541, 547; 125/11.01, 11.02, 125/11.03, 11.04, 11.05, 11.06, 11.07, 11.08, 125/11.09, 11.1, 11.11, 11.12, 11.13, 11.14, 125/11.15, 11.16, 11.17, 11.18, 11.19, 11.2, 125/11.21, 11.22, 11.23

See application file for complete search history.

(56) References Cited

U.S. PATENT DOCUMENTS 2,302,712 A * 11/1942 O'Neill ..... 125/11.13
2,327,272 A * 8/1943 Jones et al. ..... 125/11.01
2,373,187 A * 4/1945 Johanson ..... 125/11.06
3,370,385 A * 2/1968 Miller et al. ..... 451/72
3,662,498 A 5/1972 Caspers
3,744,187 A 7/1973 Lynah
3,813,828 A 6/1974 Bennett
4,274,231 A * 6/1981 Verega ..... 451/5
4,805,348 A 2/1989 Arai et al.
5,174,067 A 12/1992 Hasegawa et al.
5,205,077 A 4/1993 Wittstock
5,505,750 A 4/1996 Andrews
5,538,460 A 7/1996 Onodera
5,611,326 A * 3/1997 Caspani et al. ..... 451/540
5,645,472 A 7/1997 Magahashi et al.
5,697,832 A 12/1997 Greenlaw et al.
5,938,506 A 8/1999 Fruitman et al.
5,944,586 A * 8/1999 Sevigny et al. ..... 451/359
5,971,841 A * 10/1999 Tintelnot ..... 451/526
6,044,512 A * 4/2000 Hornby et al. ..... 451/526

FOREIGN PATENT DOCUMENTS

DE 210087 2/1968
JP 81054 5/1984

* cited by examiner

*Primary Examiner*—Timothy V. Eley
(74) *Attorney, Agent, or Firm*—Fay, Sharpe, Fagan, Minnich & McKee, LLP

(57) ABSTRACT

An apparatus for providing a flat to stepped convex facing for grinding wheels used for the finished machining of parts, the apparatus including dressing wheels located only at the outer diameter of the Cubic-Boron-Nitride wheels to be dressed.

8 Claims, 5 Drawing Sheets

FIG. 7
FIG. 8
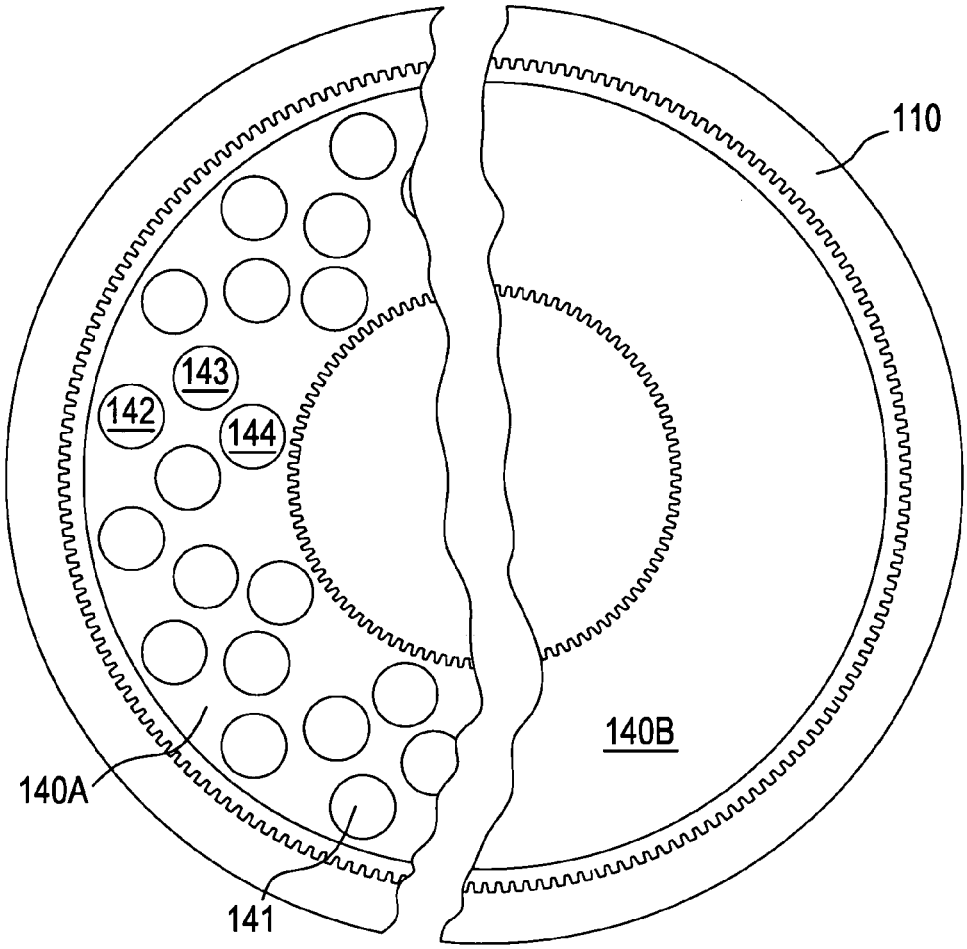
FIG. 9
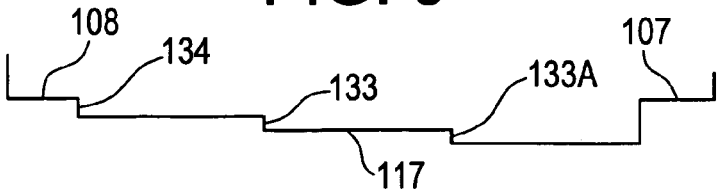
FIG. 10
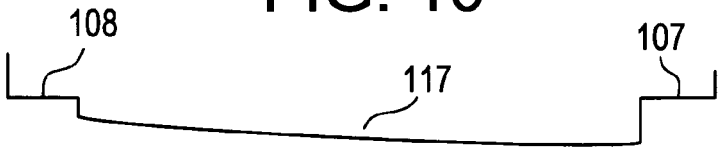

DRESSING WHEEL SYSTEM

This is a divisional of application(s) Ser. No. 09/217,380 filed on Dec. 21, 1998 now U.S. Pat. No. 6,338,672.

FIELD TO WHICH THE INVENTION RELATES

This invention relates to an improved apparatus for dressing fine grinding wheels utilized to smooth machine surfaces together with a method for utilizing same.

BACKGROUND OF THE INVENTION

Lapping and grinding machines have been utilized to manipulate the flatness of surfaces for subsequent use in mechanical and hydraulic mechanisms. The purpose of this manipulation operation is to make a surface of a part, typically metal, as smooth as possible. An example would be the opposing surfaces of the rotor utilized in the White Hydraulics, Inc. Motor as represented in White U.S. Pat. No. 5,135,369. In this example application, by flattening the opposing surfaces of the rotor, the volumetric and mechanical efficiency of the device can be increased by maintaining tighter spacing and tolerances between the flat surfaces of the rotor and adjoining surfaces of the motor housing.

In prior art two wheel grinding devices, a parts carrier assembly is located between two iron lapping wheels (it is called 'lapping' because the fine grinding particles are located in a surry and not the actual movable wheels). An example is the Hahn and Kolb Model ZL801 lapping machine. In this machine a carrier assembly consisting of a fixed outer stator, a driven inner pinion and toothed planet wheels are located between two iron lapping wheels. The parts to be lapped are located in sockets in the toothed planet wheels.

The iron lapping wheels themselves are initially dressed by a separate wheel dressing unit. The machine itself includes a source of the main cutting material, for example a silicon carbide surry, that accomplishes the actual lapping function. In the lapping operation, the devices typically operate under Rule 141 (New), double lap flatness of wheels. According to Rule 141, the flatness of the iron lapping wheels are periodically tested by the operator with a straight edge across the surface of each wheel. If one wheel in concave or low in the center, and the other wheel is convex or high in the center, then the wheels are run opposed to each other with the carrier run with the wheel which is low in the center. If both wheels are low in the center, both wheels and the center carrier are run in the same direction. If both wheels are high in the center, the wheels are run in the same direction with the carrier run in a direction opposed to the wheels. The actual rotational speed of the wheels is selected in consideration with the sizing of the work together with the amount of material to be removed.

Operations under Rule 141 require significant operator involvement in the operation of the machine and, in addition, typically an assistant to aid in the testing of the wheels to determine whether the wheels are low in the center or high in the center. In addition, the surry takes the same amount of material off of the iron lapping wheels as the parts being operated on by the machine.

The relative flatness of the lapping operation is thus normally interconnected with the tolerances of the machine together with the skill of the setup operator.

In respect to fine grinding wheels, it is necessary to periodically remove such wheels to flatten their grinding surfaces. This interrupts production while subjecting the grinding wheels to the risk of damage.

SUMMARY OF THE INVENTION

It is an object of this invention to improve the flatness of ground parts by dressing the grinding wheel.

It is an further object of this invention to reduce the cost of dressing grinding wheels.

It is another object of this invention to simplify the maintenance of grinding wheels.

It is yet another object of this invention to lower the tolerances of dressed grinding wheels and the parts manufactured thereby.

It is still a further object of this invention to increase the efficiency of manufacture of production parts.

Other objects of the invention and a more complete understanding of the invention may be had referring to the drawings in which:

DESCRIPTION OF THE DRAWINGS

FIGS. 7 and 8 are views like FIG. 1 of alternate embodiments;

FIG. 9 is a representational cross section of a multiple stepped convex surface grinding wheel dressed by the alternative of FIG. 7; and, FIG. 10 is a representational cross section of a classical curved convex surface grinding wheel, this example dressed by the alternative of FIG. 8.

DETAILED DESCRIPTION OF THE INVENTION

This invention relates to an improved dressing wheel together with the method of use therefor.

With grinding wheels, fine grinding particles (like CBN) are imbedded in the body of the wheels themselves. For this reason, it is called grinding not lapping. This has the advantage of eliminating the need for a cutting surry (although preferably a coolant such as oil is substituted for thermal stability). In addition, the fine grinding function occurs at room temperature while producing no sparks. However, using at least some grinding wheels (like CBN), the Rule 141 does not work making it necessary to totally remove the grinding wheels periodically, typically once a month or so, in order to separately dress them thus to compensate for any wear patterns which develop. This subjects the grinding wheels to the risk of damage (for example during removal and reassembly) as well as interrupting the production of finished parts on the machine.

In the present invention, the grinding wheels are dressed in place utilizing parts of the production assembly to a flat or convex grinding surface. For clarity, the invention will be described utilizing a two wheel fine grinding machine for power and control of the various elements disclosed herein. It is to be understood, however, that the general principals of the invention can be utilized in other machines as long as the principals set forth herein are incorporated.

In the present invention a dresser is differentially moved in respect to at least one grinding wheel, with the differential movement dressing the grinding wheel to have a flat to convex surface at least on the outer extent of the grinding surface for subsequent use in the manufacture of production parts. In general the faster the relative velocity between the dresser and the grinding wheel the quicker dressing will occur.

The differential movement can be provided by movement of the wheel, the dresser, or both as might be appropriate for the particular application. As it is preferred that the dressing occur with the grinding wheel mounted in place on the production manufacturing machine utilizing same. The existing controlled production movements can then be used to establish base parameters for the dressing operation. In addition change over time from production to dressing and back to production is significantly improved.

Figure 3:
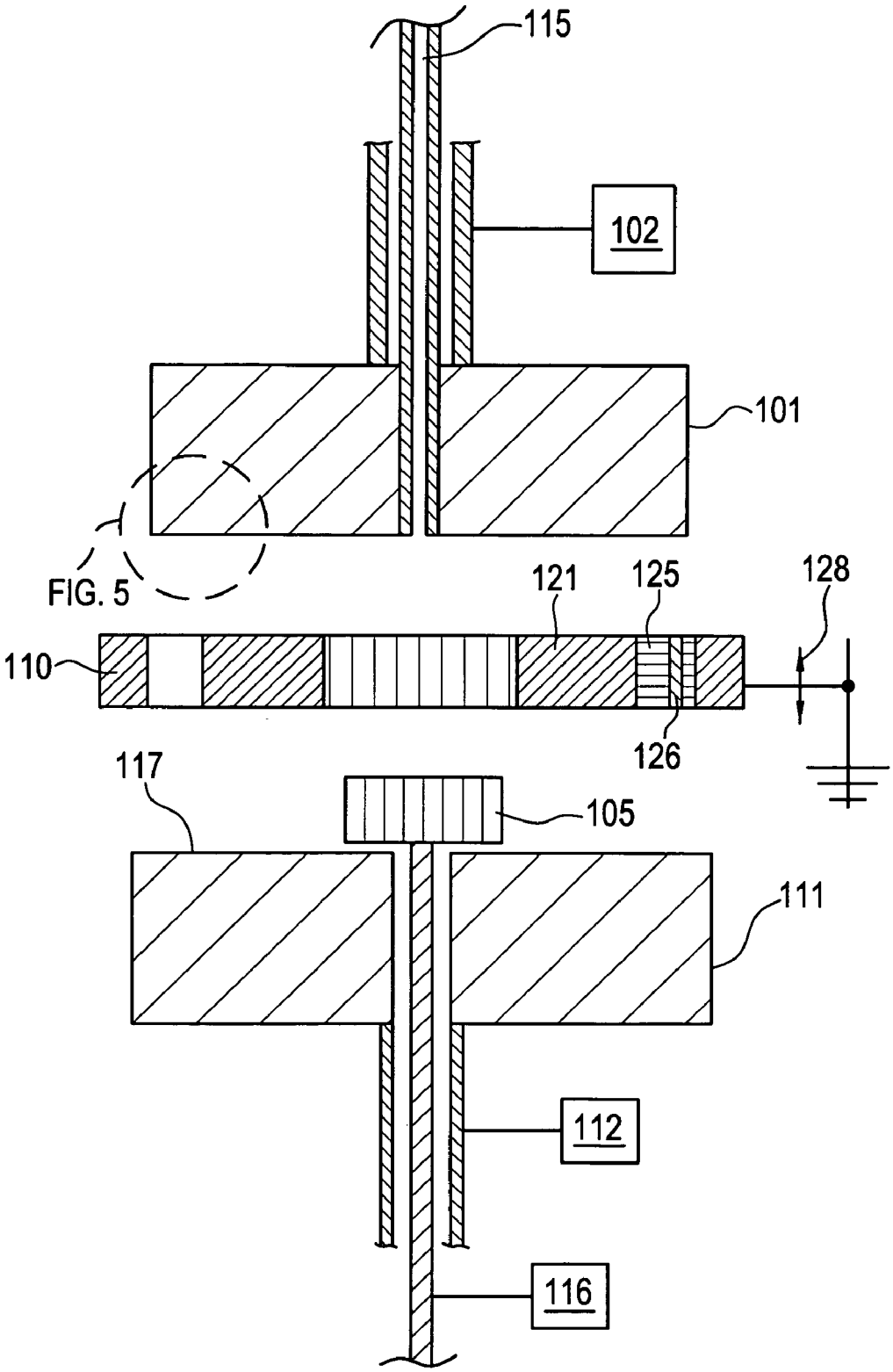
FIG. 3 is a cross sectional side view of FIG. 2 taken generally along lines 3—3 therein.

In the preferred embodiment utilized as an example herein, the production fine grinding machine has two fine grinding wheels 101, 111 with imbedded cutting materials, which wheels are each independently operationally interconnected to two motors 102, 112 (FIG. 3). The axis of rotation of the wheels 101, 111, are aligned. A pinion 105, driven by third motor 116, is located between the wheels 101, 111, for relative rotation. All are supported by bearings (not shown) to a unitary frame (also not shown). This orientation allows for each fine grinding wheel 101, 111 and the pinion 105 to be separately controlled in respect to both speed and direction of rotation. In certain other systems, differing drives and axis orientations could be utilized, for example a single motor for all moving parts in a dedicated machine, holding one grinding wheel stationary while moving the other, rotating the outer ring 110 instead of and/or in addition to the pinion 105, or otherwise controlling the relative rotations of the parts therein.

Figure 2:
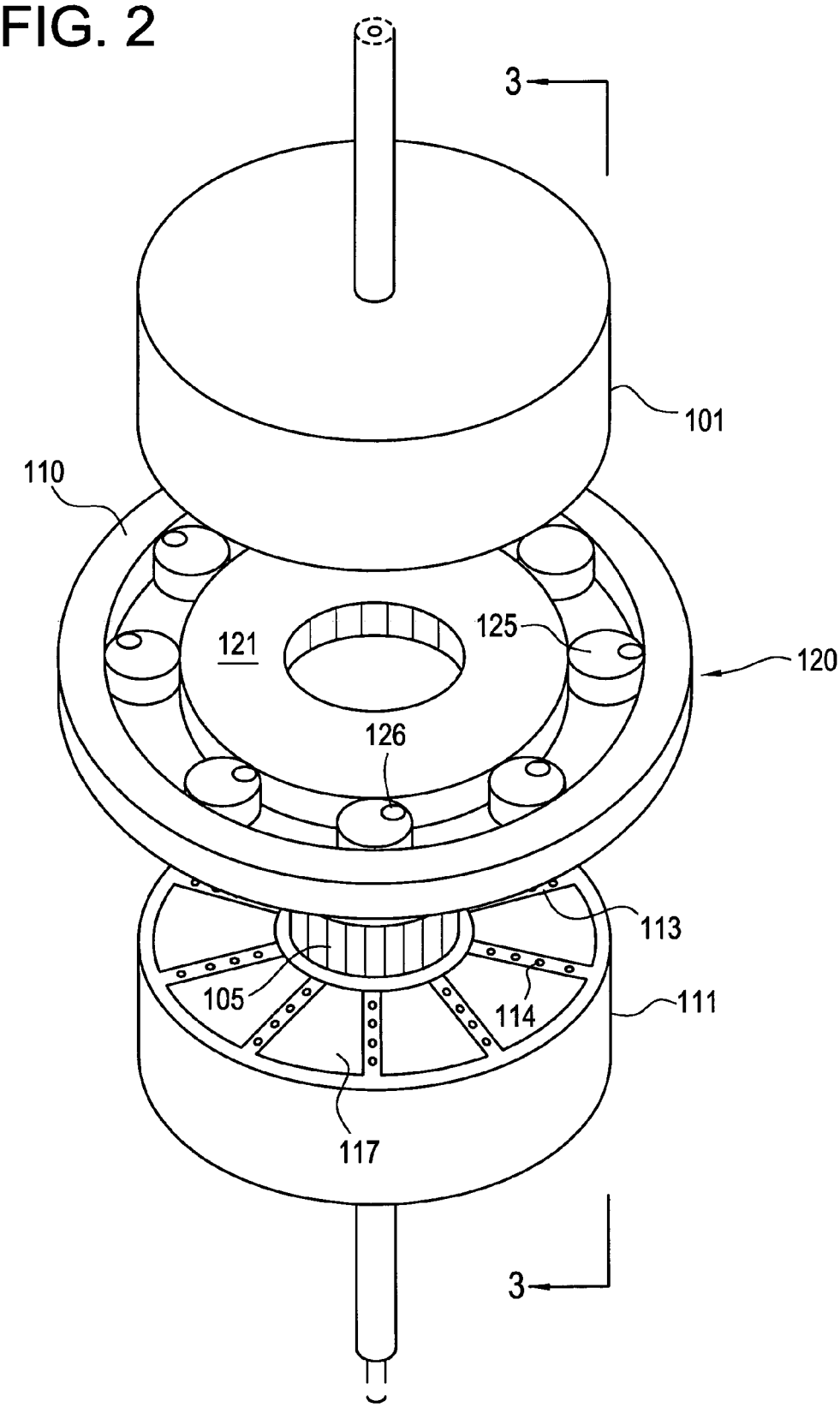
FIG. 2 is a representational expanded perspective view of two Cubic-Boron-Nitride (CBN) wheels utilized in finishing the manufactured parts with the dresser assembly of FIG. 1 in operational position.

In the particular embodiment disclosed, the two fine grinding wheels 101, 111 are made of aluminum some 38" in diameter having as cutting material CBN particles some 20 to 50 microns in diameter (the ISO 6106 DIN 848 nominal mesh is 180/150) suspended in a 3 mm thick plastic carrier at the surface of the wheels (FIG. 2). The matrix surface of the fine grinding wheels are interrupted by recessed slots 113 which, together with recessed inner edge 107 and outer edge 108, facilitate the movement of coolant to the entire surface of the CBN wheels, and holes 114 which serve to help in draining off the coolant (the coolant shown is provided to the center of the upper fine grinding wheel 101 through a feed system 115 located generally thereat. Other coolant feeds could be utilized). The recessed inner edge 107 and outer edge 108 in addition create defined end locations for the actual CBN grinding surface, thus together with an over swept dressing action eliminating any inner and outer upwards extending lip problems (FIGS. 5, 9, 10) (i.e. the edges 107, 108 are the lowest points of the CBN grinding carrier 117, although they could be coextensive with the slots 113 if desired. In addition the matrix could be segmented with edges 107, 108 coextensive with the aluminum backing.).

This CBN fine grinding wheel is used by way of example and it is to be understood that other types of grinding materials (such as diamonds) and/or surfaces (such as a longitudinal planar surface) could be substituted.

In the invention of this application, the two fine grinding wheels 101, 111 are dressed into a flat to convex shape, which shape has been ascertained to be the optimum for the flatness of resulting production parts and as having other advantages such as smoother production operation.

Figure 1:
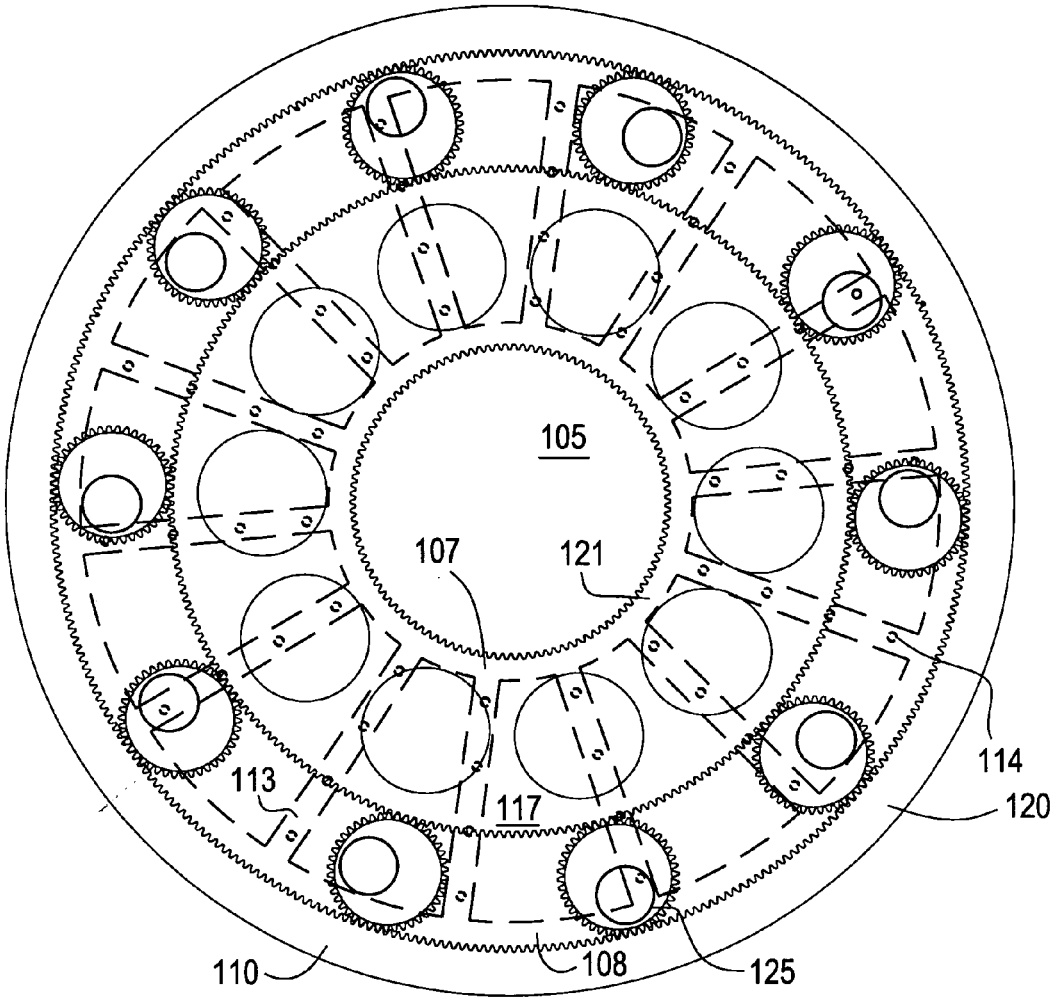
FIG. 1 is a top view of a carrier dresser assembly built in accord with the invention.
Figure 4:
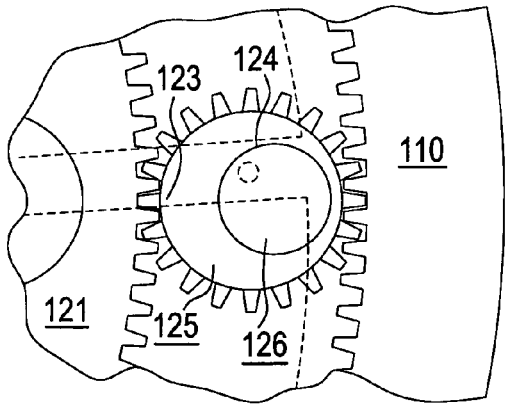
FIG. 4 is a top view of one of the planet dresser wheels of the dresser assembly of FIG. 1.
Figure 5:
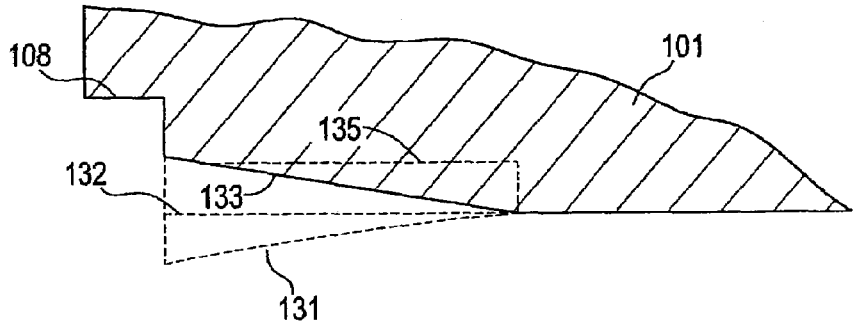
FIG. 5 is an enlarged view of the end of a CBN wheel in FIG. 3 showing concave, tapered, and flat surfaces.
Figure 6:
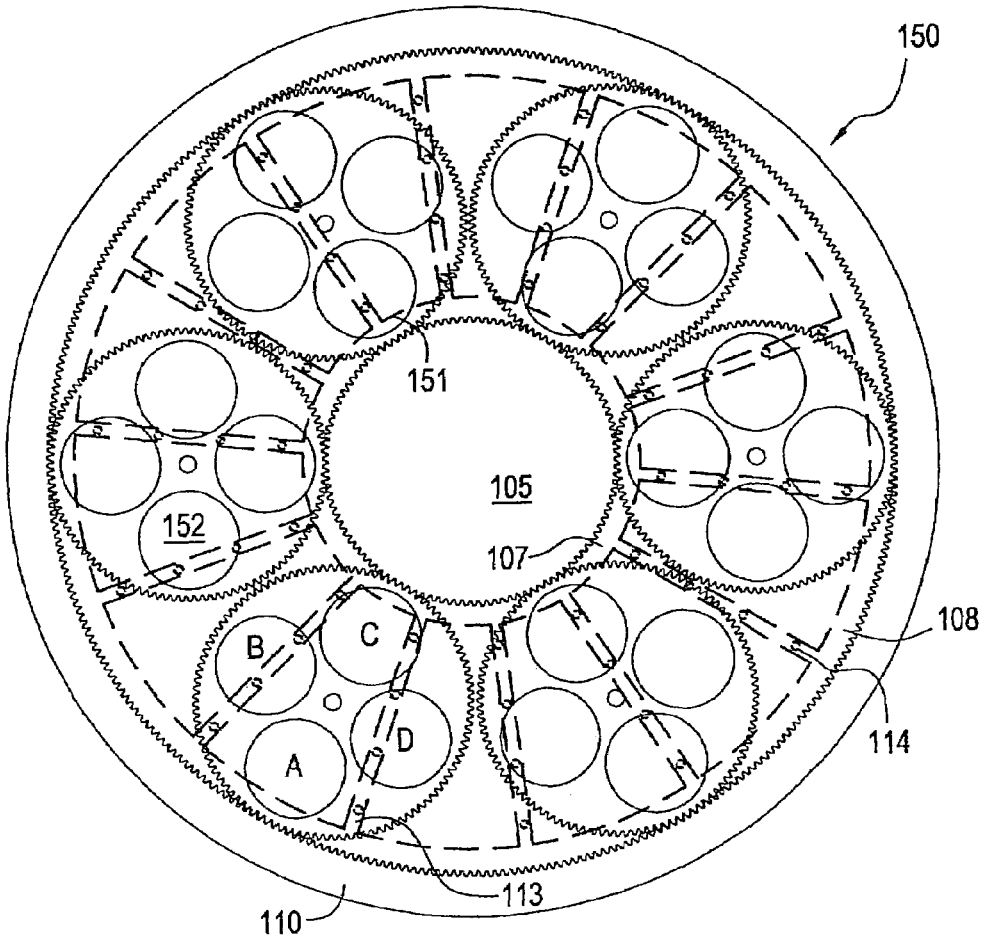
FIG. 6 is a view like FIG. 1 of a part carrier assembly utilized in the manufacture of the manufactured parts.

In the particular example shown, the fine grinding wheels 101, 111 are dressed by a dressing wheel system 120 insitu on the fine grinding machine with the outer diameter of the fine grinding wheels corrected to produce a convex shape (see FIGS. 1 and 5).

The dressing wheel system preferably includes certain operative parts of the grinding machine, in the example system 120, parts of a planetary drive provide the dressing action. This envisions the use of the same pinion drive 105 and fixed outer ring 110 as the production part carrier assembly 150 utilizes, thus simplifying the assembly and disassembly of both the dressing wheel system and the production carrier system while interchanging between the two modes. Further, since removal of the grinding wheels 101, 111 is not necessary and since no specialty fixture is utilized, overall cost and manufacturing efficiencies are increased with dressing and change over time reduced.

In the dressing wheel system 120, the fixed outer ring 110 cooperates with the pinion drive 105 to operate the dressing wheel system 120, in the preferred embodiment acting to provide for the double axis rotating motion of the planet dresser wheels 125.

In the preferred embodiment disclosed, an enlarged intermediate pinion wheel 121 is located immediately surrounding the pinion drive 105 between such drive 105 and the planet dresser wheels 125. This causes the planet dresser wheels to operate on the outer 20–40% extent of the fine grinding wheels 101 and/or 111 (33% shown) to facilitate the formation of the convex surface. The enlarged intermediate pinion wheel 121 also provides for significantly faster rotational speeds and velocity for the planet dresser wheels 125 about their own respective axis, thus providing for the potential of a more aggressive dressing operation.

Located immediately outward of the pinion extender gear 121 are the set of planetary dresser wheels 125. These are preferably relatively small in size so as to increase their relative rotational speed or velocity in respect to a given rotational speed of the pinion drive 105. In this respect note that due to the interaction of the parts of the system the relative velocity of the planet dresser wheels 125 can differ between the inside 123 and outside 124 of such wheels 125. This allows for control of the nature of the shape of the fine grinding wheels 101, 111. The small size of the planet dresser wheels 125 also ensures that primarily the outer extent of grinding wheels 101, 111 will be dressed thus to facilitate the convex shaping of the grinding wheels. The aggressiveness and the smoothness of the resulting surface is further facilitated by the optional use of later described inserts 126 spaced from the rotational center of the dresser wheels 125, which inserts removes the plastic matrix allowing the CBN to break out faster during dressing.

After the surface to be dressed is determined to have the required initial shape, dressing with the planet wheels 125 is accomplished. During dressing, the dressing wheels 125 differentially move about the grinding wheels 101, 111 to dress same. Note that in general, more surface dressed by the dresser wheels 125 per unit time, the quicker dressing will be finished. Due to this, the faster the planet dresser wheels 125 rotate in respect to a set length grinding surface, the faster dressing will occur. This is important in that in recognition of this, the differential movement does not have to be uniform between the two grinding wheels 101, 111. For example, if wheel 101 needed less dressing than wheel 111 to meet production standards, running wheel 101 at a rotational speed about the axis of the pinion more similar to that of the planet dresser wheels 125 than that of wheel 111 would reduce the dressing of wheel 101 compared to wheel 111. (Note the same differential operation is true of the inserts 126 as well.)

Although this can be accomplished in many ways, it is preferred that the planet dresser wheels 125 move about the circumference of the fine grinding wheels 101, 111 while also rotating about their own individual axis. This provides for a relatively uniform dressed surface (by reducing the effect of any out of standard component). In the example herein, this differential is provided by rotating the two fine grinding wheels 101, 111 in the same direction as and at nearly the same speed as the pinion 105 (and thus also the extender 121) with a slight upwards or downwards speed difference. This provides for an even dressed surface.

As the planet dresser wheels 125 pass over the fine grinding wheels, the fine grinding wheels 101, 111 are dressed to the desired shape. In the preferred embodiment, this is a taper shape 133 to convex shape 130, this in contrast with a concave surface 131 (shown in representational form in FIGS. 5 and 10 respectively). Note that the convex shape 130 formed by the dresser of FIG. 1 has a taper 133 (approximately 0.001" over 4" shown). This initial taper convex shape 133 is thus between a classical curved convex shape 129 and a flat surface 132. This is in recognition that a taper or stepped flat surface can provide a convex surface for purposes of this invention.

Subsequent production operation of any embodiment will tend to blend this convex grinding wheel into a flatter and flatter shape to the surface determined by the user as a trigger redressing.

The convex shape on both wheels is preferred in that this provides the flattest resulting production parts during the later manufacture thereof. It also has the advantage of not causing the planet dresser wheels 125 (nor the parts in the planet part carriers 151 of the production carrier assembly 150) to dig into the fine grinding wheels 101, 111 when passing towards the outer edge thereof.

The dressing wheel system 120 can dress one, the other, or both of the fine grinding wheels 101, 111. This selective operation is produced by either selecting a set of planet dresser wheels 125 having diamond coating or other dressing material on one axial end or having such on both ends of the planet wheels 125 or by controlling relative rotation of the parts (as later described). The selective dressing could be provided by a multiple series of unitary dressing wheels having with each series having one of the above attributes (two series total) or by centrally split dressing wheels with each individual half section having a cutting material end and a non-cutting material end (one series with twice the number of parts). To minimize complexity of changeover, two series of unitary dressing wheels are preferred. Intermediate attribute dressing wheels 125 could also be utilized if desired.

In addition to the above, the movement of the fixed outer ring 110 upwards and downwards in respect to each individual fine grinding wheel 101, 111 provides an additional control parameter by increasing or reducing the pressure of the planet dresser wheels 125 on the respective fine grinding wheel. Note that this upwards and downwards motion is not impeded by the grinding wheels 101, 111 due to the fact that the inner circumferential edge of the outer ring 110 has a diameter greater than that of the grinding surface of the grinding wheels 101, 111 (and in the example embodiment, beyond the entire wheels). This diametrical difference also allows the dresser planets 125 (and production parts in apertures 152 of the production assembly) to sweep up to and, as preferred, past the outer edge of the fine grinding wheels 101, 111.

In the present preferred embodiment, the dressing of the outer diameter of the wheels 101, 111 and the speed of the dresser wheels 125 is provided by a single part, that of an intermediate pinion extender gear 121 which is located immediately outwards of the pinion drive 105. This pinion extender gear 121 has the effect of markedly increasing the apparent diameter of the pinion drive 105 (over double—2.16 times), thus to locate the planet dresser wheels 125 at the outer extent of the grinding wheels, as well as increasing the amount of movement or velocity of the outer side 124 of the dresser gear 125 for a given speed of the pinion 105. The pitch diameter of the extender gear 121 is selected in view of the desired convex shape for the dressed grinding wheels 101, 111. In general the point where the pinion gear 121 meets the inside 123 of the planet dresser wheel 125 defines the beginning of the convex shape, with the exact nature of such shape depending on the relative speeds and direction of rotation of the moving parts. For example as later set forth with the grinding wheels 101, 111 and the pinion gear 121 running in the same direction at the same speed a taper convex shape is produced. The reason for the taper convex surface in the example is that the teeth at the inside 123 of the planet dresser 125 have substantially the same velocity of the interengaging teeth of the pinions gear 121 (and thus the CBN grinding wheels 101, 111. This produces minimal dressing—V inner gear equals V planet dresser at this point. However the teeth at the outside of the planet dresser 125 have a much higher velocity. The reason for this is that the outside edge of the CBN grinding wheels have the highest velocity in the system. This in combination with the neighboring and engaged fixed ring gear 110 produces a more aggressive dressing operation for the planet dressers 125 at the outside 124 thereof, and thus the resultant taper.

The flat to convex shape of the dressed grinding wheels can be adjusted and/or modified by altering the relative differential between the dresser and grinding wheel, for example running the pinion gear 121 in the opposite direction at the same speed would produce a stepped convex shape. Thus the speed and direction of parts and relative velocity of the dresser planets 125 are inter-related.

The preferred taper 133 is created by the relative velocity of the planet dresser wheels 125 in respect to the CBN grinding wheels 101, 111. For example with the intermediate pinion wheel 121 driven in the same direction at the same speed as the grinding wheels, the inside 123 of the planet dresser wheel 125 will have a slower relative velocity than the outside 124 of such dresser wheel 125. The reason for this is again that the inside 123 of the dresser wheel 125 is moving at a relative speed substantially equal to the intermediate pinion 121 (and thus the CBN grinding wheels) while the outside 124 of such dresser wheel 125, being engaged with the stationary outer ring 110, will be moving at a relative speed much higher than the CBN grinding wheels 101, 111. Due to this velocity difference the outside circumference of the grinding wheels is dressed more aggressively than inward thereof: hence the taper 133.

The angularity of the taper can be controlled by the speed differential between the intermediate pinion 121 and the grinding wheels 101, 111. This controls the relative velocity of the dresser wheels 125 (and thus the aggressiveness of the dressing action). For example rotating the pinion 121 faster than the grinding wheels 101, 111 would tend to more equalize the velocity differential between the inside 123 and outside 124 of the dresser wheels 125, thus producing a lesser angle taper 133 (albeit with a slight step on the area inside that swept by the dressing wheels 125 if run long enough). Additional example by running the pinion 121 in the opposite direction as the CBN grinding wheels 101, 111 the inside 123 will become as aggressive (if not more so) than the outside 124 of the planet dresser wheels 125, producing a step convex shape 135 (FIG. 5). Note that if each CBN grinding wheel 101, 111 can be individually controlled, one can vary the aggressiveness of the dressing action differentially between such wheels. This is of benefit if one grinding has a more convex initial shape than the other grinding wheel (the former needing less dressing than the latter and thus a lesser velocity between the planet dresser wheel and the grinding wheel).

The present invention utilizes planet dresser wheels 125 which rotate about the axis of the pinion drive 105 at speeds different than that of the CBN fine grinding wheels 101, 111 about their respective axis in order to provide for an aggressive cut. Further, this aggressive cut is accomplished primarily on the outside diameter of the CBN fine grinding wheels so as to provide for two convex wheels, thus eliminating the need to compensate for possible differing shapes (concave/convex) of two fine lapping wheels during production as was done under Rule 141 (previously described), while also eliminating the need to remove the CBN wheels to grind them flat (as previously required since Rule 141 does not satisfy the maintenance needs of fine grinding wheels).

The particular fixed outer ring 110 has a pitch diameter of 38.97" with 336 inner teeth, the pinion drive 105 has a pitch diameter of 13.46" with 114 outer teeth, the enlarged pinion wheel 121 has a pitch diameter of 29.05" with 246 outer teeth, and the planet dresser wheels 125 have a pitch diameter of 4.96" with 42 outer teeth. (The production planet part carriers 151 have a pitch diameter of 12.76" with 108 outer teeth and the apertures 152 therein are 4.63" in diameter.) The inserts 126 are 2.5" in diameter. The example dressing action occurs with both the pinion 121 and CBN grinding wheels 101, 111 rotating in the same direction at approximately 70 RPM. Dressing is complete in substantially three seconds producing a taper of some 4" in length having a drop from 0.001 to 0.003" from the outside of the CBN grinding wheels 101, 111 to the inside 123 of the planet dresser wheels 125.

The dresser wheels 125 may be used by themselves or in conjunction with one or more inserts 126, which inserts 126 are utilized in the preferred embodiment to remove some of the matrix holding the cutting material to initially define a flat to convex shape.

The dresser wheels 125 are used by themselves when a simple dressing is necessary to produce the desired convex shape. For example if in the preferred embodiment after dressing the plastic matrix and CBN have an acceptable length of usability for the subsequent production operation after dressing while still maintaining the preferred convex shape. For consistency, it is preferred that the standard for this "simple dressing" reflect a pre-established objective criteria such as number of parts able to be ground in subsequent production, matrix thickness drop over the convex shape, time of previous (or subsequent) grinding operation, etc. This would simplify dressing and subsequent manufacturing production by allowing a uniform procedure to be followed. This would tend to reduce operator error, tolerance deviances, and other problems.

If the convex shape is less than a sufficient amount on the area to be dressed, for example the selected standard, inserts 126 are inserted into the dresser wheels 125. The purpose of these inserts 126 is to initially remove the matrix and some of the cutting material, thus to initially shape the grinding wheels to a convex shape. To accomplish this, it is preferred that the inserts 126 have a height greater than that of the dresser wheels 125 together with a hardness greater than the matrix but less than that of the cutting material. These attributes would allow the inserts 126 to act on the matrix independently of the dressing material on the dresser wheels 125 (due to the height differential) while removing the matrix without substantive compromising harm to the cutting material like CBN embedded therein (due to the relative hardness). The number of inserts utilized preferably is selected dependent on the amount of matrix to be removed: The less material to be removed, the greater the hardness of the inserts and, the slower the speed of the inserts, the fewer the number of inserts need be utilized.

The exact initial shape defined by the inserts 126 is dependant on the location and relative velocity thereof. In general, as previously set forth in respect to the planet dresser wheels 125 the higher the relative velocity of the inserts 126 in respect to the fine grinding wheels 101, 111 the more material will be removed per unit time. However, this should be tempered with a recognition of the more central location of the inserts 126 in respect to the planet wheels 125 as well as that the softer plastic matrix breaks out faster than the CBN grinding material. For this reason the inserts 126 tend to create more of a stepped surface than a taper in this initial shaping—i.e. the relative hardness overcomes velocity differential.

The use of the inserts 126 can be before, after, or intermediate dressing by dresser wheels 125. Further again, one or both wheels 101, 111 can be subject to the inserts 126 (having differing hardness between the axial ends of integral inserts 126, or by splitting same into two differing hardness parts and/or differing relative velocities can be used to provide differential initial matrix removal between the grinding wheels 101, 111.). As with the planet dresser wheels, two series of inserts are again preferred.

In the preferred embodiment, the surface of the grinding wheels 101, 111 are preferably dressed at or before when such surface is flat and smooth. At this time, if necessary the inserts 126 of RC 66 aluminum oxide are utilized until approximately 30% to 66% of the diameter of the CBN cutting material is left exposed and the desired convex shape is initially produced in the plastic matrix. This gives a surface substantially equal to 100 grit sand paper prior to dressing by the dressing wheels 125. After a sufficient amount of the cutting material is exposed, it is preferred that the inserts 126 be removed. This allows that height differential between such inserts 126 and the dresser wheels 125 be maintained for subsequent use of such inserts 126. The grinding wheels 101, 111 are then dressed by the planet dressers 125 to the preferred convex shape.

Upon completion of the dressing operation (i.e., preferably both fine grinding wheels 101, 111 being convex), the planet dresser wheels 125 and intermediate pinion extender gear 121 are removed from the machine and a production carrier assembly 150 substituted.

In the example utilized herein this production carrier assembly 150 includes the pinion drive 105, six intermediate toothed part carriers 151 and the fixed outer ring 110. As the pinion drive 105 and fixed outer ring 110 are also utilized in the dressing wheel system 120 the change over is easily accomplished with minimal concern for tolerances.

After the assembly of the production carrier 150, the parts to be ground are inserted in the apertures 152 present in these part carriers 151 so as to pass them over the CBN dressing wheels in the double rotating manner inherent in a planetary type device. This production operation continues until dressing is again needed, at which time the dressing wheel system 120 is reassembled.

Although the invention has been described in its preferred form with a certain degree of particularity, it is to be understood that changes can be made deviating from the invention as hereinafter claimed. For example, it is possible to utilize all of the production part carrier assembly 150 for dressing the grinding wheels, for example inserting dressing wheels in one or all of four (A, B, C, D) of the four apertures 152 (and if appropriate inserts) therein. This would, however, necessitate an additional step of warping the grinding wheel to produce a concave shape 131 (for example by temporarily shimming the outer circumference thereof downward during dressing) in order to dress the preferred outer radial extent of such grinding wheels to produce a convex surface. With stationary carriers 151 and rotating grinding wheels 101, 111, alternately as the apertures 152 go outwards from C to B to A, more aggressive dressing materials could be utilized in the apertures. Without either of these options, a flat grinding surface would be produced due to the rotation of the carriers 151 in respect to the grinding wheels 101, 111. Additional examples a pinion extender 140 having multiple pockets 141 can be assembled about the pinion 105 out of contact with the surrounding fixed ring gear 110 (FIG. 7). Dresser wheels 125A would be inserted into the pockets 141 so as to dress the grinding wheels 101, 111. With all pockets occupied, this alternative produces substantially the grinding wheel surface of FIG. 9. Note that the pockets 141 shown are arranged into three offset rows, with each row at least extending to touch the area swept by an adjoining row. By varying the number and location of the dresser wheels 125A the amount and location of dressing can be adjusted. As previously set forth in respect to the preferred embodiment it is preferred that the outre radial extent of the grinding wheels be dressed to a convex shape, in general more dresser wheels 125A would be inserted in the outer row 142 than any other. The middle and inner rows 143, 144 are preferably more for maintenance of the inner surface of the grinding wheels 101, 110 and would thus normally utilize a lesser number of dresser wheels 125A (if any). A further alternative would be to make the dressing materials integral with a modified no-pocket pinion extender platter 140B having two concave surfaces, one for each grinding wheel 101, 111, again out of contact with the outer ring 110—i.e. it is not necessary to use separate dresser wheels 125A). This would form the preferred convex grinding surfaces utilizing a single additional member 140A in combination with existing production assembly parts. This alternative would produce the grinding wheel surface of FIG. 10. The extent of the dressing materials would again be selected to provide the preferred dressing operation. Therefor many changes can be made without deviating from the invention as herein after claimed.

What is claimed:

1. In a system utilizing a fine grinding wheel, the wheel having a fine grinding surface with an outer radial extent to an outer diameter, the improvement of a dressing wheel system, the dressing wheel system including dressing material, said dressing material having a radial extent less than the radial extent of the fine grinding surface, means to bring said dressing material and the outer radial extent of the fine grinding surface into physical contact, movement means to move said dressing material and the fine grinding surface relative to one another and, means to flex the outer radial extent of the grinding surface to form a concave surface during operation of said movement means to provide a flat to convex shape to the fine grinding surface.

2. In a system utilizing a fine grinding wheel, the wheel having a fine grinding surface with a radial extent to an outside diameter, the system having a production carrier assembly including planet gears and a pinion drive, the improvement of a dressing wheel system, the dressing wheel system including dressing material, said dressing material having a radial extent less than the radial extent of the fine grinding surface, means to bring said dressing material and the radial extent of the fine grinding surface into physical contact, movement means to move said dressing material and the fine grinding surface relative to one another to provide a convex shape to the fine grinding surface, said movement means utilizing at least part of the production carrier assembly and the pinion drive, and said convex shape including a taper.

3. The system of claim 2 characterized in that said convex shape includes at least one step.

4. In a system utilizing a fine grinding wheel, the wheel having a fine grinding surface with a radial extent to an outside diameter, the system having a production carrier assembly including planet gears and a pinion drive, the improvement of a dressing wheel system, the dressing wheel system including dressing material, said dressing material having a radial extent less than the radial extent of the fine grinding surface, means to bring said dressing material and the radial extent of the fine grinding surface into physical contact, movement means to move said dressing material and fine grinding surface relative to one another to provide a convex shape to the fine grinding surface, said movement means utilizing at least part of the production carrier assembly and the pinion drive, and said convex shape is a curved shape.

5. In a system utilizing a fine grinding wheel, the wheel having a fine grinding surface with an outer radial extent neighboring an outside circumference, the fine grinding wheel being used in a system having a production assembly the improvement of the outer 20–40% of the outer radial extent of the fine grinding wheel having a convex shape, wherein the fine grinding surface is formed of cutting materials embedded in a carrier and characterized by the dressing wheel system including removal means to remove the carrier to expose the cutting materials.

and said outer 20–40% of the outer radial extent of the grinding wheel being dressed to said convex shape utilizing at least part of the production assembly, and said fine grinding wheel is dressed by differential movement means that includes planet gears and means selectively to insert said removal means to said planet gears.

6. The system of claim 5 characterized in that said differential movement means including at least part of the production assembly.

7. The system of claim 5 wherein said production assembly having a pinion drive gear and characterized by said differential movement means of said dressing wheel system utilized the pinion drive gear.

8. The system of claim 7 wherein the pinion drive has a gear with a diameter and characterized in that said differential movement means includes an intermediate pinion extender gear, and said extender gear increasing the apparent diameter of the pinion drive gear.

* * * * *